United States Patent [19]

Takada et al.

[11] Patent Number: 4,668,614

[45] Date of Patent: May 26, 1987

[54] SILVER HALIDE PHOTOGRAPHIC LIGHT SENSITIVE MATERIALS

[75] Inventors: Shunji Takada; Naoto Ohshima; Shingo Ishimaru, all of Kanagawa, Japan

[73] Assignee: Fuji Photo Film Co., Ltd., Kanagawa, Japan

[21] Appl. No.: 917,318

[22] Filed: Oct. 10, 1986

Related U.S. Application Data

[63] Continuation of Ser. No. 687,347, Dec. 28, 1984, abandoned.

[30] Foreign Application Priority Data

Dec. 29, 1983 [JP] Japan ..... 58-248469

[51] Int. Cl.[4] ..... G03C 1/08

[52] U.S. Cl. ..... 430/567; 430/570; 430/599

[58] Field of Search ..... 430/567, 570, 599

[56] References Cited

U.S. PATENT DOCUMENTS 4,444,877 4/1984 Koitabashi et al. ..... 430/569

4,477,564 10/1984 Cellone et al. ..... 430/567

FOREIGN PATENT DOCUMENTS 1350619 4/1974 Japan ..... 430/567

OTHER PUBLICATIONS

Hirsch, "Photographic Emulsion Grains with Coves," Part 1 and 2, Journal of Photo. Science, vol. 10, 1962, pp. 129–146.

*Primary Examiner*—Won H. Louie

*Attorney, Agent, or Firm*—Sughrue, Mion, Zinn, Macpeak and Seas

[57] ABSTRACT

An improvement in silver halide photographic light-sensitive materials having at least one silver halide emulsion layer on a support is disclosed. The improvement is that chemically sensitized silver halide grains contained in at least one of the emulsion layers have a distinct stratiform structure having substantially two parts comprising an inside core part and a shell part of the uppermost layer, wherein the inside core part of said grains is composed of silver halide containing 10 to 45% by mol of silver iodide, the shell part of the uppermost layer of the grains is composed of silver halide containing 5% by mol or less of silver iodide, and the emulsion containing silver halide grains having the distinct stratiform structure have an average silver iodide content of 7% by mol or more. The materials have high sensitivity, low fog and excellent graininess.

23 Claims, 1 Drawing Figure

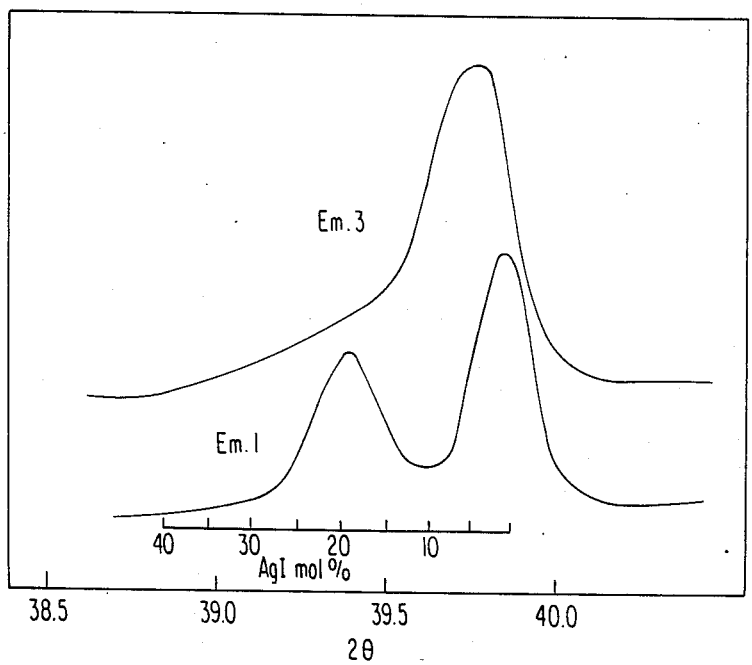
Em.3
Em.1
40
30
20
10
AgI mol %
38.5
39.0
39.5
40.0
2θ

SILVER HALIDE PHOTOGRAPHIC LIGHT SENSITIVE MATERIALS

This is a continuation of application Ser. No. 687,347 filed 12/28/84, now abandoned.

FIELD OF THE INVENTION

The present invention relates to silver halide photographic light-sensitive materials and, particularly, to silver halide photographic light-sensitive materials using emulsions composed of silver halide grains having a novel internal structure.

BACKGROUND OF THE INVENTION

Fundamental characteristics required for photographic silver halide emulsions are high sensitivity, low fog, fine granularity and high development activity. Though silver halide includes silver fluoride, silver chloride, silver bromide and silver iodide, silver fluoride is not used for photographic emulsions because the silver fluoride has high water solubility. Accordingly, efforts to improve the fundamental characteristics of emulsions have been performed by combining silver chloride, silver bromide and silver iodide. Light absorption increases in the order of silver chloride, silver bromide and silver iodide, but development activity decreases in the above described order. Therefore, it is difficult for the light absorption to be compatible with the development activity. E. Klein and E. Moisar have disclosed mixed silver halide emulsions comprising silver halide cores coated with different silver halide layers (specifically, the grain is composed of a silver bromide nucleus, a first layer composed of silver iodobromide containing 1% by mol of silver iodide, and an external layer composed of silver bromide), by which light-sensitivity is enhanced without damaging development activity. (Japanese Patent Publication No. 13162/68)

Koitabashi et al have disclosed that photographically suitable characteristics, such as improvement of covering power, etc., are obtained when a thin shell having a thickness of 0.01 to 0.1 μm is coated on a core grain having a comparatively low silver iodide content. (Japanese Patent Application (OPI) No. 154232/82) (The term "OPI" as used herein refers to a "published an unexamined Japanese patent application".)

These inventions are useful in case that the core part has a low silver iodide content and, consequently, the total silver iodide content is low. However, in order to obtain higher sensitivity and higher quality images, the silver iodide content of the emulsions must necessarily be increased.

It is well known that light absorption increases up to a limited amount of solid solution (about 45% by mol) with increases of the silver iodide content. Accordingly, it has been desired to develop emulsions containing cores having a high silver iodide content and having a high total silver iodide content. Silver iodobromide emulsions containing cores having a high silver iodide content have been disclosed in Japanese Patent Publication No. 21657/74 by Arai and Ueda. According to this patent publication, cores containing 25% by mol or 40% by mol of silver iodide are prepared and, thereafter, the shell is formed thereon by adding potassium bromide and an aqueous solution of silver nitrate.

X-ray diffraction of the resulting grains shows that the prepared emulsion does not have a complete core/shell structure (Japanese Patent Publication No. 21657/74). As shown in the example at column 5, lines 40–45, it is very difficult to develop silver halide emulsions containing' cores having a high silver iodide content and having a high total silver iodide content, which have a distinct stratiform structure.

SUMMARY OF THE INVENTION

Accordingly, one object of the present invention is to provide silver halide photographic light-sensitive materials having high sensitivity, low fog and excellent graininess.

Another object of the present invention is to provide silver halide emulsions having high light absorption efficiency and high development activity and photographic light-sensitive materials using them.

As a result of earnest studies, the present inventors have found that these objects of the present invention can be attained by silver halide emulsions composed of a silver halide wherein the core part has a silver iodide content of 10 to 45% by mol and the shell part of the uppermost layer contains 5% by mol or less of silver iodide, with a total silver iodide content being 7% by mol or more, in which the silver halide grain has a distinct stratiform structure having substantially two parts.

BRIEF DESCRIPTION OF THE DRAWINGS

FIG. 1 shows X-ray diffraction patterns of emulsion grains, wherein the abscissa indicates the angle of diffraction (2 $\theta$) and the ordinate indicates the intensity of diffraction. $Em^1$ indicates the X-ray diffraction pattern of Emulsion 1, and $Em^3$ indicates the X-ray diffraction pattern of Emulsion 3.

DETAILED DESCRIPTION OF THE INVENTION

One of reasons why the silver halide emulsions used in the present invention have high sensitivity is that light absorption increases because a high silver iodide content can be obtained without reducing development activity. However, it is believed that a larger effect on sensitivity is obtained by the fact that the grains have a distinct stratiform structure wherein the core part has a high silver iodide content and the uppermost layer has a low silver iodide content, by the which efficiency of latent image formation is improved. This is an unexpected effect, and the details of the mechanism are not known. However, it is believed that bending occurs in the band structure near the interface between the high silver iodide content core and the low silver iodide content shell part of the uppermost layer, and that due to the bending, holes move into the inside of the grains and accelerate separation of electric charges of electrons and holes.

The distinct stratiform structure in the present specification can be confirmed by X-ray diffractiometry. An example of applying the X-ray diffractiometry to silver halide grains has been described in H. Hirsch, *Journal of Photographic Science,* vol. 10 (1962), pp. 129. When the lattice constant is determined on the basis of halogen composition, a diffraction peak is formed in the angle of diffraction which satisfies Bragg's condition ($2d \sin \theta = n\lambda$).

The manner of measuring the X-ray diffraction has been described in detail in *Kiso Bunseki Kagaku Koza* (Lecture of Fundamental Analysis Chemistry), "X-Sen Benseki" (X-Ray Analysis), published by Kyoritsu Shuppan and *X-Sen Kaiseki No Tebiki* (Manual of X-Ray Diffraction), published by Rigaku Denki Co. A standard method of measurement is carried out in such a manner that a diffraction curve of the face (220) of the silver halide is determined by using Cu as a target with a K$\beta$ ray of Cu as a ray source (tube electric potential: 40 KV, tube electric current: 60 mA). In order to increase the resolving power of the apparatus for measurement, it is necessary to confirm the accuracy of the measurement by using a standard sample such as silicon, silver bromide, etc. and selecting a suitable width of the slit (radiation slit, light receiving slit, etc.), time constant of the apparatus, scanning rate of the goniometer and recording rate. When diffraction of the face (220) of a well annealed silver bromide powder is measured using the K$\beta$ ray of Cu, a diffraction line appears near 39.9° of 2 $\theta$. If the measuring condition is suitable, the half-value width of the diffraction line is about 0.1.

When the emulsion grains have a distinct stratiform structure having two parts, a diffraction maximum due to silver halide in the high silver iodide content core and a diffraction minimum due to silver halide in the low silver iodide content shell part of the uppermost layer appear, whereby two peaks are formed on the diffraction curve.

The distinct stratiform structure having substantially two parts in the present invention means that when a curve of diffraction intensity of the face (220) of silver halide to angle of diffraction (2$\theta$) is obtained using a K$\beta$ ray of Cu in a range of an angle of diffraction of 38° to 42° , two diffraction maximums of a diffraction peak corresponding to the high silver iodide content core containing 10 to 45% by mol of silver iodide and a diffraction peak corresponding to the low silver iodide content shell part of the uppermost layer containing 5% by mol or less of silver iodide appear and one minimum appears between them, the diffraction intensity of the peak corresponding to the high silver iodide content core is 1/10 to 3/1, preferably 1/5 to 3/1, more preferably $\frac{1}{3}$ to 3/1, of the diffraction intensity of the peak corresponding to the low silver iodide content shell part of the uppermost layer.

As emulsions having a distinct stratiform structure having substantially two parts in the present invention, those wherein the diffraction intensity of the minimum value between two peaks is 90% or less of the diffraction maximum (peak) having the lower intensity of the two diffraction maximums are preferred.

For the minimum between the two peaks, 80% or less is more preferred and 60% or less is particularly preferred.

The manner of analyzing the diffraction curve composed of two diffraction components is well known and described in, for example, *Jikken Butsurigaku Koza* (Lecture of Experimental Physics), No. 11, "Koshi Kekkan" (Failure of Lattice), published by Kyoritsu Shuppan.

It is effective to analyze the curve with a curve analyzer produced by E.I. Du Pont de Numours and Company on the assumption that it is a function such as a Gauss function or a Lorentz function.

In an emulsion containing two kinds of grains, each having a different halogen composition, which do not have a distinct stratiform structure, two peaks also appear in the above described X-ray diffraction pattern.

However, such an emulsion cannot show excellent photographic performances as obtained in the present invention.

Whether the silver halide emulsion is an emulsion according to the present invention or the aforesaid emulsion wherein two kinds of silver halide grains are present can be judged by an EPMA process (Electron-Probe Micro Analyzer process) in addition to X-ray diffractiometry.

In the EPMA process, a sample in which emulsion grains are well dispersed so as not to contact one another is produced, and irradiated with electron beams. Elemental analysis of very fine parts can be carried out by X-ray analysis of electron ray excitation.

According to the EPMA process, the halogen composition of individual grains can be determined by measuring the X-ray intensities of silver and iodine emitted from each grain.

Whether the emulsion is that of the present invention or not can be determined, if the halogen composition of at least 50 grains is confirmed by the EPMA process.

In the emulsions of the present invention, it is preferred that the silver iodide content of each grain is uniform.

It is preferred, when measuring the distribution of the silver iodide content of the grains, that the standard deviation is 50% or less, preferably, 35% or less and, particularly, 20% or less.

As the halogen composition of silver halide grains having a distinct stratiform structure of the present invention, preferred examples are as follows.

The core part is silver halide having a high silver iodide content, wherein the silver iodide content is preferred to be in a range of from 10% by mol to 45% by mol which is the limited amount of solid solution.

The silver iodide content is preferably in a range of 15 to 45% by mol and, more preferably, 20 to 45% by mol.

In addition to the case wherein the optimum value of the core silver iodide content is in a range of 20 to 45% by mol, there is the case wherein the optimum value is in a range of about 35 to 45% by mol, depending upon the process for preparing the emulsion grains.

In the core part, the silver halide other than silver iodide may be either or both of silver chlorobromide and silver bromide, but it is preferred that the amount of silver bromide is higher.

The composition of the shell part of the uppermost layer preferably consists of silver halides containing 5% by mol or less of silver iodide and, more preferably, silver halides containing 2% by mol or less of silver iodide.

In the shell part of the uppermost layer, the silver halide other than silver iodide may be any of silver chloride, silver chlorobromide and silver bromide, but it is preferred that the amount of silver bromide is higher than the amount of the other silver halide.

The composition of the part very near the surface, i.e. several tens of Angstroms from the surface, of the grain is important for obtaining suitable photographic properties. The composition of the part very near the surface can be determined by XPS (X-ray photoelectron spectrometry). Silver halide containing 5% by mol or less of silver iodide is preferred. As silver halide, any of silver chloride, silver chlorobromide and silver bromide may be used, but it is preferred that the amount of silver bromide is higher than the amount of other silver halides. Further, in order to increase adsorption of the dye, it is sometimes effective to increase the silver iodide content of the part very near the surface.

With respect to the total halogen composition of the whole silver halide grains having a distinct stratiform structure, the effect of the present invention is remarkably excellent when the silver iodide content is 7% by mol or more.

A preferable total silver iodide content of the whole grain is 9% by mol or more and, particularly, 12% by mol or more..

The grain size of silver halide grains having a distinct stratiform structure of the present invention is not particularly limited, but it is preferred to be 0.4 μm or more, preferably 0.8 μm or more and, particularly, 1.4 μm or more.

Silver halide grains having a distinct stratiform structure of the present invention are more useful for high-speed emulsions having a large grain size such as those having a grain size of 0.8 μm or more, preferably 1.4 μm or more.

Silver halide grains having a distinct stratiform structure of the present invention may have any of regular crystal forms (normal crystals) such as hexahedron, octahedron, dodecahedron or tetradecahedron, and irregular crystal form such as sphere, pebble-like form or tabular form, etc.

In case of normal crystals, grains having 50% or more of the face (111) are particularly suitable. In case of irregular crystal forms, grains having 50% or more of the face (111) are particularly suitable as well.

The face rate of the face (111) can be determined by a Kubelka-Munk's dye adsorption process. In this process, a dye which is preferentially adsorbed on either the face (111) or the face (100), wherein the association state of the dye on the face (111) is spectrometrically different from that of the dye on the face (100), is selected. Such a dye is added to the emulsion and spectra to the amount of the dye added are examined in detail by generally known methods, by which the face rate of the face (111) can be determined.

The emulsions of the present invention may have a wide distribution of grain size, but emulsions having a narrow distribution of grain size are preferable. Particularly, in the case of normal crystal grains, monodispersed emulsions wherein the grain size of grains accounting for 90% of the whole of the emulsion, based on the weight or number of silver halide grains, is within ±40% and preferably within ±30% of the average grain size are preferred.

The emulsions having a distinct stratiform structure of the present invention can be prepared by selecting from and combining various processes known in the field of silver halide photographic light-sensitive material.

In order to prepare core grains, the process can be selected from an acid process, a neutral process, an ammonia process, etc. As a type of reacting soluble silver salts with soluble halogen salts, a one-side mixing process, a simultaneous mixing process and a combination of the mixing processes may be employed.

As one type of the simultaneous mixing process, a process wherein pAg in a liquid phase in which silver halide is formed is kept constant, namely, a controlled double jet process, can be used. As another type of the simultaneous mixing process, a triple jet process which comprises adding separately soluble halogen salts having each a different composition (for example, a soluble silver salt, a soluble bromide and a soluble iodide) can be used, too. Solvents for silver halide such as ammonia, rhodanides, thioureas, thioethers or amines, etc. may be used when preparing the core part. Emulsions in which the distribution of grain size of core grains is narrow are suitable. The above described monodispersed core emulsions are particularly suitable. Emulsions in which halogen composition, particularly silver iodide content, of each grain is more uniform in the stage of preparing the core are preferred.

Whether the halogen composition of each grain is uniform or not can be judged by the above described X-ray diffractiometry and the EPMA process. In the case that the halogen composition of core grains is more uniform, the diffraction width of the X-ray diffraction pattern is narrow to give a sharp peak.

Japanese Patent Publication No. 21657/74 has disclosed a process for preparing core grains having a uniform halogen composition. An example is a double jet process, wherein 5 g of inactive gelatin and 0.2 g of potassium bromide are dissolved in 700 ml of distilled water, the resulting solution is stirred at 50° C, 1 l of an aqueous solution having 52.7 g of potassium bromide and 24.5 g of potassium iodide dissolved therein and 1 l of an aqueous solution having 100 g of silver nitrate dissolved therein are added simultaneously at the same constant rate to the above described solution under stirring over about 80 minutes, and distilled water is added to make the whole amount 3 l, by which silver iodobromide having a silver iodide content of 25% by mol is obtained. As a result of X-ray diffractiometry, it is seen that the silver iodobromide grains have a comparatively narrow distribution of iodine. Another example is a rush addition process, wherein an aqueous solution of 33 g of inactive bone gelatin, 5.4 g of potassium bromide and 4.9 g of potassium iodide dissolved in 500 ml of distilled water is stirred at 70° C, and 125 ml of an aqueous solution having 12.5 g of silver nitrate dissolved therein is added in a moment to the above solution to obtain comparatively uniform silver iodobromide grains having a silver iodide content of 40% by mol.

Japanese Patent Application (OPI) No. 16124/81 has disclosed that uniform silver iodobromide grains are obtained using a silver iodobromide emulsion having a halogen composition of 15 to 40% by mol of silver iodide by keeping pAg of a liquid containing a protective colloid at a range of 1 to 8.

Uniform silver iodobromide grains are also obtained by growing silver iodobromide grains after formation of seed crystals of silver iodobromide containing silver iodide in a high concentration, by a process which comprises accelerating the rate of addition with the passage of time as disclosed in Japanese Patent Publication No. 3689/73 by Irie and Suzuki, or a process which comprises increasing the concentration for addition with the passage of time disclosed in U.S. Pat. No. 4,242,445 by Saito. The process by Irie et al is that for producing sparingly soluble inorganic salt crystals for use in photography by a double decomposition reaction which comprises simultaneously adding two or more kinds of aqueous solutions of inorganic salt in nearly equal amounts in the presence of a protective colloid, wherein the aqueous solution of inorganic salt to be subjected to reaction is added at a rate of addition, Q, which is more than a certain rate of addition and is less than a rate of addition proportional to the whole surface area of said sparingly soluble inorganic salt crystals which are growing, namely, $Q=r$ or more and $Q=\alpha t^2+\beta t+\gamma$ or less, wherein $\alpha$, $\beta$ and $\gamma$ are each a constant determined by experiment and t is a lapse time from commencement of reaction.

On the other hand, the process by Saito is that for producing silver halide crystals which comprises adding simultaneously two or more kinds of aqueous solutions of inorganic salt in the presence of a protective colloid, wherein the concentration of the aqueous solution of inorganic salt to be subjected to reaction is increased to a degree of hardly forming fresh crystal nuclei during the growth of crystals.

In reparation of the silver halide grains having a distinct stratiform structure of the present invention, shell formation may be carried out directly after formation of core grains, but it is preferred to carry out formation of shells after the core emulsion is washed with water to remove salts.

Shell formation can be carried out by various processes known in the field of silver halide photographic light-sensitive materials, but a simultaneous mixing process is suitably used. The above described process by Irie et al and the process by Saito are preferred as processes for producing emulsions having a distinct stratiform structure. In order to obtain suitable photographic properties in the emulsions comprising silver halide grains having a distinct stratiform structure, the core composed of silver halide having a high silver iodide content should be sufficiently coated with the shell composed of silver halide having a low silver iodide content. The thickness of the shell depends upon grain size, but it is preferred that large grains having a grain size of 1.0 μm or more are coated with a shell having a thickness of 0.1 μm or more and small grains having a grain size of less than 1.0 μm are coated with a shell having a thickness of 0.05 μm or more. In order to obtain emulsions having a distinct stratiform structure, the ratio of silver content in the core part to the shell part is preferred to be in a range of 1/5 to 5, preferably 1/5 to 3 and, particularly, 1/5 to 2.

As described above, silver halide grains which have a distinct stratiform structure having substantially two parts mean that the grains have substantially two regions having each a different halogen composition, wherein the center side of the grains is called the core part and the surface side is called the shell part.

The phrase "substantially two parts" means that a third region other than the core part and the shell part (for example, a layer between the central core part and the uppermost shell part) may be present.

However, the third region should be present only to the extent of not having a substantial influence upon the shape of the two peaks (which correspond to the part having a high silver iodide content and the part having a low silver iodide content) when an X-ray diffraction pattern is given as described above.

Namely, silver halide grains wherein a core part, an intermediate part and a shell part having a low silver iodide content are present, two peaks are present and one minimum part is present between two peaks in the X-ray diffraction pattern, the diffraction intensity corresponding to the part having a high silver iodide content is 1/10 to 3/1, preferably 1/5 to 3/1 and, particularly ⅓ to 3/1 of that of the part having a low silver iodide content, and the diffraction intensity of the minimum part is 90% or less, preferably 80% or less and, particularly 60% or less of the smaller peak of two peaks, are grains having a distinct stratiform structure having substantially two parts.

The case wherein a third region is present in the inside of the core part is similar to the above described case.

In the formation of silver halide grains or physical ripening of the grains according to the present invention, cadmium salts, zinc salts, lead salts, thallium salts, iridium salts or complexes thereof, rhodium salts or complexes thereof, iron salts or complexes thereof, and the like may be present in the system.

The silver halide emulsion of the present invention is chemically sensitized. Chemical sensitization can be carried out by processes as described, e.g., in H. Frieser (ed.), *Die Grundlagen der Photographischen Prozesse mit Silberhalogeniden,* pp. 675–734, Akademische Verlagsgesellschaft (1968).

More specifically, chemical sensitization can be carried out by sulfur sensitization using compounds containing sulfur capable of reacting with active gelatin or silver ions (e.g., thiosulfates, thioureas, mercapto compounds, rhodanines, etc.); reduction sensitization using reducing materials (e.g., stannous salts, amines, hydrazine derivatives, formamidinesulfinic acid, silane compounds, etc.); noble metal sensitization using noble metal compounds (e.g., gold complexes, and complexes of Periodic Table Group VIII metals such as Pt, Ir, Pd, etc.); and the like individually or in combinations thereof.

Specific examples of sulfur sensitization are described in U.S. Pat. Nos. 1,574,944, 2,410,689, 2,278,947, 2,728,668, 3,656,955, etc. Specific examples of reduction sensitization are described in U.S. Pat. Nos. 2,983,609, 2,419,974, 4,054,458, etc. Specific examples of noble metal sensitization are described in U.S. Pat. Nos. 2,399,083, 2,448,060, British Patent No. 618,061, etc.

Protective colloids or binders of other hydrophilic colloidal layers which can be used to advantage in the production of the silver halide emulsions having a distinct stratiform structure of the present invention include conventional gelatins. Other hydrophilic colloids may also be used.

Examples of the hydrophilic colloids include proteins, such as gelatin derivatives, graft polymers of gelatin with other high polymers, albumin, casein, etc.; cellulose derivatives, such as hydroxyethyl cellulose, carboxymethyl cellulose, cellulose sulfate, etc.; sugar derivatives, such as sodium alginate, starch derivatives, etc.; and various synthetic hydrophilic high molecular weight substances, such as polyvinyl alcohol, partially acetylated polyvinyl alcohol, poly-N-vinylpyrrolidone, polyacrylic acid, polymethacrylic acid, polyacrylamide, polyvinylimidazole, polyvinylpyrazole, etc. and copolymers containing repeating units which constitute the above-described polymers.

Examples of the gelatins which can be used include not only lime-processed gelatin but also acid-processed gelatin and enzyme-processed gelatin as described in *Bull. Soc. Sci. Photo. Japan,* No. 16, p. 30 (1966). Hydrolysis products and enzymatically decomposed products of gelatin can also be employed.

Photographic emulsions used in the present invention can contain various compounds for the purpose of preventing fog during preparation, storage, or photographic processing, or for stabilizing photographic properties. Such compounds include azoles, such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole), etc.; mercaptopyrimidines; mercaptotriazines;

thioketo compounds, such as oxazolinethione, etc.; azaindenes, such as triazaindenes, tetraazaindenes (especially 4-hydroxy-substituted (1,3,3a,7)tetraazaindenes), pentaazaindenes, etc.; benzenethiosulfonic acid; benzenesulfinic acid; benzenesulfonic acid amide; and other various compounds known as anti-foggants or stabilizers. Such compounds are described in more detail, e.g., in U.S Pat. Nos. 3,954,474 and 3,982,947, and Japanese Patent Publication No. 28660/77.

The photographic emulsions used in the photographic light-sensitive materials of the present invention can further contain, for example, polyalkylene oxides and derivatives thereof, such as ethers, esters and amines thereof, thioether compounds, thiomorpholines, urea derivatives, imidazole derivatives, 3-pyrazolidones, and the like for the purpose of increasing sensitivity or contrast or accelerating development. Specific examples of these compounds are described, e.g., in U.S. Pat. Nos. 2,400,532, 2,423,549, 2,716,062, 3,617,280, 3,772,021 and 3,808,003, British Patent No. 1,488,991, etc.

The photographic emulsions which can be used in the present invention may be spectrally sensitized with methine dyes and other sensitizing dyes. Useful sensitizing dyes include cyanine dyes, merocyanine dyes, complex cyanine dyes, complex merocyanine dyes, holopolar cyanine dyes, hemicyanine dyes, styryl dyes and hemioxonol dyes, with cyanine dyes, merocyanine dyes and complex merocyanine dyes being particularly useful. Any of basic heterocyclic nuclei generally used for cyanine dyes can be applied to these dyes. Such nuclei include pyrroline, oxazoline, thiazoline, pyrrole, oxazole, thiazole, selenazole, imidazole, tetrazole and pyridine nuclei, and the like; the above-described nuclei to which an alicyclic hydrocarbon ring is fused; and the above-described nuclei to which an aromatic hydrocarbon ring is fused, such as indolenine, benzindolenine, indole, benzoxazole, naphthoxazole, benzothiazole, naphthothiazole, benzoselenazole, benzimidazole and quinoline nuclei, etc. These nuclei may be substituted at their carbon atoms.

Nuclei having a keto-methylene structure can be used for merocyanine dyes or complex merocyanine dyes. Such nuclei include 5- to 6-membered heterocyclic nuclei, such as pyrazolin-5-one, thiohydantoin, 2-thiooxazolidine-2,4-dione, thiazolidine-2,4-dione, rhodanine and thiobarbituric acid nuclei, and the like.

The above-described sensitizing dyes may be used alone or in combinations of two or more thereof. Combinations of sensitizing dyes are frequently employed for the purpose of supersensitization. Typical examples of supersensitizing combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patents 1,344,281 and 1,507,803, Japanese Patent Publication Nos. 4936/68 and 12375/78, Japanese Patent Application (OPI) Nos. 110618/77 and 109925/77, etc.

The photographic emulsions may additionally contain a substance which has an effect of supersensitization when used in combination with sensitizing dyes but does not exhibit per se spectral sensitizing effect or does not substantially absorb visible light.

Hydrophilic colloidal layers of the light-sensitive materials prepared in accordance with the present invention may contain water-soluble dyes as filter dyes or for other purposes, e.g., prevention of irradiation, etc. Examples of such dyes include oxonol dyes, hemioxonol dyes, styryl dyes, merocyanine dyes, cyanine dyes and azo dyes, with oxonol dyes, hemioxonol dyes, and merocyanine dyes being particularly useful.

The photographic emulsions and other hydrophilic colloidal layers of the light-sensitive materials prepared in accordance with the present invention may contain whitening agents, such as stilbene types, triazine types, oxazole types, and coumarin types. These whitening agents may be either water-soluble or water-insoluble. In the latter case, they can be used in the form of a dispersion.

In carrying out the present invention, known discoloration inhibitors, as described below, can be used. Further, color image stabilizers can also be used individually or in combinations of two or more thereof. Examples of known discoloration inhibitors include, for example, hydroquinone derivatives as described in U.S. Pat. Nos. 2,360,290, 2,418,613, 2,675,314, 2,701,197, 2,704,713, 2,728,659, 2,732,300, 2,735,765, 2,710,801 and 2,816,028, British Patent 1,363,921, etc.; gallic acid derivatives as described in U.S. Pat. Nos. 3,457,079 and 3,069,262, etc.; p-alkoxyphenols as described in U.S. Pat. Nos. 2,735,765 and 3,698,909, Japanese Patent Publication Nos. 20977/74 and 6623/77, etc.; p-oxyphenol derivatives as described in U.S. Pat. Nos. 3,432,300, 3,573,050, 3,574,627, and 3,764,337, Japanese Patent Application (OPI) Nos. 35633/77, 147434/77 and 152225/77; bisphenols as described in U.S. Pat. Nos. 3,700,455, etc.; and the like.

The light-sensitive materials prepared in accordance with the present invention may further contain a color fog preventing agent, such as a hydroquinone derivative, an aminophenol derivative, a gallic acid derivative, an ascorbic acid derivative, and the like.

The present invention can be applied to either black-and-white light-sensitive materials or multilayer multicolor light-sensitive materials. Application of the present invention to multilayer multicolor light-sensitive materials for high sensitivity photographing is particularly preferred.

Multilayer color photographic materials usually have at least one red-sensitive emulsion layer, at least one green-sensitive emulsion layer and at least one blue-sensitive emulsion layer on a support. The order of these layers can be arbitrarily selected. It is most common to incorporate a cyan forming coupler in a red-sensitive emulsion layer, a magenta forming coupler in a green-sensitive emulsion layer, and a yellow forming coupler in a blue-sensitive emulsion layer, respectively. Different combinations may also be used in some cases.

Yellow forming couplers which can be used include known open-chain ketomethylene couplers. Of these, benzoyl acetanilide couplers and pivaloyl acetanilide couplers are advantageous. Specific examples of the useful yellow forming couplers are disclosed, e.g., in U.S. Pat. Nos. 2,875,057, 3,265,506, 3,408,194, 3,551,155, 3,582,322, 3,725,072, and 3,891,445, West German Patent 1,547,868, West German Patent Application (OLS) Nos. 2,219,917, 2,261,361, and 2,414,006, British Patent 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77, and 115219/77, etc.

Magenta forming couplers which can be used include pyrazolone couplers, indazolone couplers, cyanoacetyl couplers, and the like, with pyrazolone couplers being particularly advantageous. Specific examples of the useful magenta forming couplers are disclosed, e.g., in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Patent 1,810,464, West German Patent Application (OLS) Nos. 2,408,665, 2,417,945, 2,418,959, and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76, and 55122/78, etc.

Cyan forming couplers which can be used include phenol couplers, naphthol couplers, and the like. Specific examples of the useful cyan forming couplers are described, e.g., in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, and 4,004,929, West German Patent Application (OLS) Nos. 2,414,830 and 2,454,329, Japanese Patent Application (OPI) Nos. 59838/73, 26034/76, 5055/73, 146828/76, 69624/77 and 90932/77, etc.

Cyan couplers which can preferably be used are those having an ureido group in their molecule as disclosed, e.g., in Japanese Patent Application (OPI) Nos. 204545/82, 65134/81, 33252/83, 33249/83, etc.

Colored couplers which can be used in the present invention are those disclosed, e.g., in U.S. Pat. Nos. 2,521,908, 3,034,892, and 3,476,560, Japanese Patent Publication Nos. 2016/69, 22335/63, 11304/67, and 32461/69, Japanese Patent Application (OPI) Nos. 26034/76 and 42121/77, West German Patent Application (OLS) No. 2,418,959, etc.

DIR (development inhibitor releasing) couplers which can be used in the present invention are those disclosed, e.g., in U.S. Pat. Nos. 227,554, 3,617,291, 3,632,345, 3,701,783, and 3,790,384, West German Patent Application (OLS) Nos. 2,414,006, 2,454,301 and 2,454,329, British Patent 953,454, Japanese Patent Application (OPI) Nos. 69624/77 and 122335/74, Japanese Patent Publication No. 16141/76, etc.

In addition to the DIR couplers, the light-sensitive material may contain other compounds capable of releasing development inhibitors with the progress of development, such as those described, e.g., in U.S. Pat. Nos. 3,297,445 and 3,379,529, West German Patent Application (OLS) No. 2,417,914, Japanese Patent Application (OPI) Nos. 15271/77 and 9116/78, etc.

Further, couplers capable of releasing development accelerators or fogging agents with the progress of development, such as those described in Japanese Patent Application (OPI) No. 150845/82, can be used to advantage.

Still further, non-diffusible couplers capable of forming slightly diffusible dyes, such as those described in British Patent 2,083,640, can be used to advantage.

The foregoing couplers can be used in an amount of from $2\times10^{-3}$ to $5\times10^{-1}$ mole, and preferably from $1\times10^{-2}$ to $5\times10^{-1}$ mole, per mole of silver in the emulsion layer.

The light-sensitive materials prepared in accordance with the present invention may contain an ultraviolet absorbent in the hydrophilic colloidal layer. Examples of ultraviolet absorbents which can be used include benzotriazole compounds substituted with an aryl group as described, e.g., in U.S. Pat. No. 3,533,794; 4-thiazolidone compounds as described in, e.g., U.S. Pat. Nos. 3,314,794 and 3,352,681; benzophenone compounds as described, e.g., in Japanese Patent Application (OPI) No. 2784/71; cinnamic ester compounds as described, e.g., in U.S. Pat. Nos. 3,705,805 and 3,707,375; butadiene compounds as described, e.g., in U.S. Pat. No. 4,045,229; and benzoxazole compounds as described, e.g., in U.S. Pat. No. 3,700,455, and, further, those disclosed in U.S. Pat. No. 3,499,762 and Japanese Patent Application (OPI) No. 48535/79. Ultraviolet absorbing couplers, e.g., $\alpha$-naphthol type cyan forming couplers, or ultraviolet absorbing polymers may also be used. These ultraviolet absorbents may be mordanted in a specific layer.

In the case of applying the present invention to color light-sensitive materials, the layer in which the emulsion according to the present invention is present is not particularly restricted, but it is preferred to be used in a blue-sensitive layer and, particularly, a high-speed blue-sensitive layer. Further, it is preferred that fine silver halide grains having a grain size of 0.2 $\mu$m or less are allowed to exist so as to be adjacent to said emulsion layer.

Conventional methods and processing solutions can be applied to photographic processing of the light-sensitive materials according to the present invention. Processing temperatures are generally selected from the range of from 18° C to 50° C. However, temperatures lower than 18° C or higher than 50° C may also be employed. Any photographic processing, including monochromatic photographic processing involving formation of a silver image, and color photographic processing involving formation of a dye image, can be used depending on the desired end use of the light-sensitive material.

In particular, when the light-sensitive material of the present invention is subjected to parallel development represented by color development, very satisfactory results can be obtained in terms of sensitivity and graininess properties.

Color development solutions generally comprise an alkaline aqueous solution containing a color developing agent. The color developing agent includes known aromatic primary amine developers, such as phenylenediamines (e.g., 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline, 4-amino-3-methyl-N-ethyl-N-$\beta$-methoxyethylaniline, etc.).

After color development, the photographic emulsion layers are usually subjected to bleaching. Bleaching may be carried out simultaneously with fixing, or these two treatments may be carried out separately. Examples of bleaching agents which can be used include compounds of polyvalent metals, such as iron (III), cobalt (III), chromium (VI), copper (II), etc.; peroxy acids, quinones, nitroso compounds, and the like. More specifically, usable bleaching agents include ferricyanides; bichromates; organic complex salts formed by iron (III) or cobalt (III) and aminopolycarboxylic acids, such as ethylenediaminetetraacetic acid, nitrilotriacetic acid, 1,3-diamino-2-propanoltetraacetic acid, etc., or organic acids, such as citric acid, tartaric acid, malic acid, etc.; persulfates; permanganates; nitrosophenol; and the like. Among these compounds, potassium ferricyanide, sodium (ethylenediaminetetraacetato)ferrate (III) and ammonium (ethylenediaminetetraacetato)ferrate (III) are particularly useful. The (ethylenediaminetetraacetato)iron (III) complexes are useful in both an independent bleaching solution and a combined bleach-fix solution.

The present invention will now be illustrated in greater detail with reference to examples, but it should be understood that these examples do not limit the present invention. In the examples, all percents are given by weight unless otherwise indicated.

EXAMPLE 1

An aqueous solution prepared by dissolving 20 g of inactive gelatin, 3.2 g of potassium bromide and 0.99 g of potassium iodide in 900 ml of distilled water was stirred at 80° C. To the solution, 150 cc of an aqueous solution of 5.0 g of silver nitrate was added at once, and the mixture was subjected to physical ripening for 20 minutes. Then, according to the process described in U.S. Pat. No. 4,242,445, 1/5 mol /l, 1/1.5 mol /l and 2 mols/l of aqueous solutions of silver nitrate and potassium halide (mixture of 80% by mol of potassium bromide and 20% by mol of potassium iodide) were added, respectively, at a flow rate of 10 cc per minute to grow 20% by mol of silver iodobromide grains. In order to remove salts, it was washed with water to prepare an emulsion A. The finished amount of the emulsion was 900 g. To 450 g of the emulsion A, 700 cc of distilled water and 30 cc of 10% potassium bromide were added, and the mixture was heated to 75° C with stirring. To the mixture, 800 cc of an aqueous solution containing 100 g of silver nitrate and 860 cc of an aqueous solution containing 75 g of potassium bromide were added at the same time over 60 minutes, and core grains in the emulsion A were allowed to grow so as not to form again the cores to prepare a silver iodobromide emulsion 1 having a silver iodide content of 10% by mol. By carrying out the same procedure as in emulsion A, a silver iodobromide emulsion B of 42% by mol was produced. To 300 g of the emulsion B, 850 cc of distilled water and 30 cc of 10% potassium bromide were added, and the mixture was heated to 75° C with stirring. To the mixture, 300 cc of an aqueous solution containing 33 g of silver nitrate; and 320 cc of an aqueous solution containing 25 g of potassium bromide were added at the same time over 30 minutes, and, further, 800 cc of an aqueous solution containing 100 g of silver nitrate and 860 cc of an aqueous solution containing 75 g of potassium bromide were added at the same time over 60 minutes to prepare a silver iodobromide emulsion 2 having a silver iodide content of 14% by mol. By carrying out the same procedure as in the emulsion A, a silver iodobromide emulsion C of 30% by mol was prepared, and shell formation was carried out according to the process described in Japanese Patent Publication No. 21657/74. Namely, to 300 g of the emulsion C, 850 cc of distilled water and 100 g of potassium bromide were added, and the mixture was kept at 70° C. Then, 800 cc of an aqueous solution containing 133 g of silver nitrate was added dropwise at a constant rate over 40 minutes to prepare a silver iodobromide emulsion 3 having a silver iodide content of 10% by mol. By carrying out the same procedure as in the emulsion A, a silver iodobromide emulsion D of 42% by mol was prepared, and shell formation was carried out by the same manner as in the emulsion 3 to prepare a silver iodobromide emulsion 4 having a silver iodide content of 14% by mol. By carrying out the same procedure as in the emulsion A, a silver iodobromide emulsion E of 18% by mol was prepared. To 300 g of the emulsion E, 850 cc of distilled water and 30 cc of 10% potassium bromide were added, and the mixture was heated to 75° C with stirring. To the mixture, 300 cc of an aqueous solution containing 33 g of silver nitrate and 320 cc of an aqueous solution containing 22.5 g of potassium bromide and 1.9 g of potassium iodide were added at the same time over 45 minutes, and, further, 800 cc of an aqueous solution containing 100 g of silver nitrate and 860 cc of an aqueous solution containing 69 g of potassium bromide and 5.9 g of potassium iodide were added at the same time over 90 minutes to prepare a silver iodobromide emulsion 5 having a silver iodide content of 10% by mol. By carrying out the same procedure is in the emulsion A, a silver iodobromide emulsion F of 12% by mol was prepared. To 790 g of the emulsion F, 1500 cc of distilled water and 60 cc of 10% potassium bromide were added, and the mixture was heated to 75° C with stirring. To the mixture, 150 cc of an aqueous solution containing 12.5 g of silver nitrate and 160 cc of an aqueous solution containing 9.5 g of potassium bromide were added at the same time over 15 minutes to prepare a silver iodobromide emulsion 6 having a silver iodide content of 10.5% by mol. By carrying out the same procedure as in the emulsion A, a silver iodobromide emulsion G of 6% by mol was prepared. 300 g of the emulsion G was taken out and shell formation was carried out by nearly the same manner as in the emulsion 2 to produce a silver iodobromide emulsion 7 having a silver iodide content of 2% by mol. By carrying out the same procedure as in the emulsion A, a silver iodobromide emulsion H of 2% by mol was prepared. To 450 g of the emulsion H, 700 cc of distilled water and 30 cc of 10% potassium bromide were added, and the mixture was heated to 75° C with stirring. To the mixture, 800 cc of an aqueous solution containing 100 g of silver nitrate and 860 cc of an aqueous solution containing 71.5 g of potassium bromide and 1.95 g of potassium iodide were added at the same time over 80 minutes to prepare a silver iodobromide emulsion 8 having a silver iodide content of 2% by mol. The eight emulsions prepared as described above are summarized in Table 1. Silver iodide content in Table 1 is the numerals on formulation in the case of core formation and in the case of shell formation. The ratio of core/shell is a ratio of silver amount used for core formation to silver amount used for shell formation. Distinct stratiform structure is classified into that wherein two peaks appear by the above described X-ray diffractiometry (YES) and that wherein only one peak appears without separation of the peak (NO). In Table 1, data of X-ray diffractiometry of the emulsions 1 and 3 are shown as examples. In order to adjust the average grain size of emulsions having each a different silver iodide content and distribution, the temperature of processing and the time of addition were controlled, and emulsions having an average grain size of near 1.5 μm were selected. (The grain size was obtained by determining an average volume of grains by a Coulter counter method (*The Theory of Photographic Process,* 4th ed., p. 101) and calculating the diameter of a corresponding sphere.)

It was determined from observation by an electron microscope that silver halide grains were composed chiefly of double twinning grains and pebble-like grains, and the face (111) was between 70 and 80% by a Kubelka-Munk method.

As shown in FIG. 1, the emulsion 1 has two distinct peaks on about 20% by mol and about 1.5% by mol, and it was an emulsion having a distinct stratiform structure.

The shell thickness of silver halide grains in the emulsion 1 was about 0.16 μm on calculation.

The emulsion 2 had two distinct peaks on about 40% by mol and about 2.0% by mol. The shell thickness of the grains was about 0.23 μm on calculation. The emulsions 3 and 4 were emulsions in which the grain size and the silver iodide content were controlled according to processes described in Japanese Patent Publication No. 21657/74. As shown in FIG. 1, the emulsion 3 has a single peak near about 5% by mol and shows a silver iodide distribution extending to the high silver iodide side. The emulsions 3 and 4 do not have the distinct stratiform structure. The emulsion 5 had peaks on about 18% by mol and about 6.5% by mol. The emulsion 6 had a shell thickness of 0.03 μm on calculation, which did not show two distinct peaks by X-ray diffractiometry because the silver amount of the shell part was small. The emulsion 7 had adjacent two peaks by X-ray diffractiometry, wherein the silver iodide contents of the corresponding peaks were about 5.5% by mol and 0% by mol. The emulsion 8 had a single peak on about 2% mol.

The above 8 kinds of emulsions were subjected to optimum chemical sensitization with sodium thiosulfate and chloroaurate to produce the following samples.

To a triacetyl cellulose film support provided with a subbing layer, an emulsion layer and a protective layer were applied in amounts shown in Table 2.

TABLE 1

| Emulsion No. | Silver iodide content on formulation (% by mol) Core | Shell | Ratio of core/shell | Total silver iodide content (% by mol) | Distinct stratiform structure | Grain size (μm) |
|---|---|---|---|---|---|---|
| 1 (This invention) | 20 | 0 | 1/1 | 10.0 | YES | 1.40 |
| 2 (This invention) | 42 | 0 | 1/2 | 14.0 | YES | 1.53 |
| 3 (Comparison) | 30 | 0 | 1/2 | 10.0 | NO | 1.44 |
| 4 (Comparison) | 42 | 0 | 1/2 | 14.0 | NO | 1.51 |
| 5 (Comparison) | 18 | 6 | 1/2 | 10.0 | YES | 1.58 |
| 6 (Comparison) | 12 | 0 | 7/1 | 10.5 | NO | 1.45 |
| 7 (Comparison) | 6 | 0 | 1/2 | 2.0 | YES | 1.45 |
| 8 (Comparison) | 2 | 2 | 1/1 | 2.0 | NO | 1.55 |

TABLE 2

(1) Emulsion layer

Emulsion: Emulsions 1 to 8 shown in Table 1 (silver $2.1 \times 10^{-2}$ mol/m$^2$)

Coupler: ($1.5 \times 10^{-3}$ mol/m$^2$)

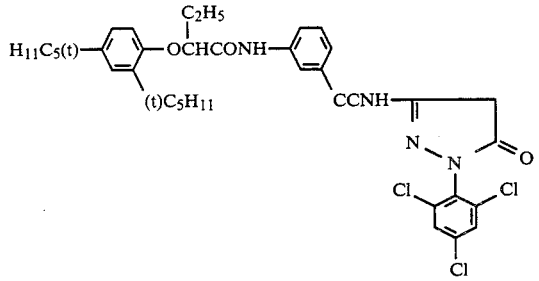

Tricresyl phosphate (1.10 g/m$^2$)

Gelatin (2.30 g/m$^2$)

(2) Protective Layer 2,4-dichlorotriazine-6-hydroxy-s-triazine sodium salt (0.08 g/m$^2$)

TABLE 2-continued

Gelatin (1.80 g/m$^2$)

After these samples were allowed to stand for 14 hours at 40° C. under a relative humidity of 70%, they were exposed to light for sensitometry and then subjected to color development processing.

Density of the processed samples was measured using a green filter. Results of photographic performance obtained are shown in Table 3.

The development processing used here was carried out at 38° C. under the following conditions.

| | |
|---|---|
| 1. Color development | 2 minutes and 45 seconds |
| 2. Bleach | 6 minutes and 30 seconds |
| 3. Water wash | 3 minutes and 15 seconds |
| 4. Fixation | 6 minutes and 30 seconds |
| 5. Water wash | 3 minutes and 15 seconds |
| 6. Stabilization | 3 minutes and 15 seconds |

Compositions of processing solutions used in each steps are as follow.

| | |
|---|---|
| Color developing solution: | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—ethyl-N—β-hydroxyethylamino)-2-methylaniline sulfate | 4.5 g |
| Water to make | 1 l |
| Bleaching solution: | |
| Ammonium bromide | 160.0 g |
| Aqueous ammonia (28%) | 25.0 ml |
| Ethylenediaminetetraacetic acid sodium iron salt | 130 g |
| Glacial acetic acid | 14 ml |
| Water to make | 1 l |
| Fixing solution: | |
| Sodium tetrapolyphosphate | 2.0 g |
| Sodium sulfite | 4.0 g |
| Ammonium thiosulfate (70%) | 175.0 ml |
| Sodium bisulfite | 4.6 g |
| Water to make | 1 l |
| Stabilizing solution: | |
| Formalin | 8.0 ml |
| Water to make | 1 l |

TABLE 3

| Sample No. | Emulsion No. | Fog | Gamma | Relative sensitivity* |
|---|---|---|---|---|
| 1 (This invention) | 1 | 0.14 | 0.80 | 210 |
| 2 (This invention) | 2 | 0.15 | 0.70 | 260 |
| 3 (Comparison) | 3 | 0.15 | 0.70 | 130 |
| 4 (Comparison) | 4 | 0.14 | 0.60 | 120 |
| 5 (Comparison) | 5 | 0.15 | 0.55 | 60 |
| 6 (Comparison) | 6 | 0.15 | 0.55 | 50 |
| 7 (Comparison) | 7 | 0.15 | 0.90 | 100 |
| 8 (Comparison) | 8 | 0.14 | 0.75 | 85 |

*Relative sensitivity is shown as a relative value based on the sensitivity at Sample 7 being 100.

As is obvious from Table 3, Samples 1 and 2 of the present invention had very excellent photographic performances.

EXAMPLE 2

Eight types of octahedral monodispersed silver iodobromide core grains having an AgI content between 0 and 40% by mol were prepared by a controlled double jet process in the presence of ammonia. The average grain size was 1.6 μm. It was ascertained by X-ray diffractiometry of these grains that sharp peaks were obtained on angles of diffraction corresponding to each silver iodide content and the grains had a uniform silver iodide content.

After the above described emulsions were washed with water, shell formation was carried out with pure silver bromide by a controlled double jet process until the silver amount of the core part became equal to that of the shell part Average grain size of these emulsions 9 to 16 and position of two distinct diffraction peaks thereof were measured. Results are shown in Table 4.

TABLE 4

| Emulsion No. | Silver iodide content on formation | | Silver iodide content by X-ray diffraction | | Total silver iodide content on formulation (mol %) | Average grain size (μm) |
|---|---|---|---|---|---|---|
| | Core (mol %) | Shell (mol %) | Core (mol %) | Shell (mol %) | | |
| 9 (Comparison) | 0 | 0 | Two peaks do not appear | 0 | 0 | 2.01 |
| 10 (Comparison) | 2 | 0 | Two peaks do not appear | 1 | 1 | 2.06 |
| 11 (Comparison) | 5 | 0 | 5 | 0 | 2.5 | 2.03 |
| 12 (Comparison) | 9 | 0 | 9 | 1 | 4.5 | 1.98 |
| 13 (This invention) | 15 | 0 | 14 | 1 | 7.5 | 2.09 |
| 14 (This invention) | 20 | 0 | 19 | 1.5 | 10 | 2.05 |
| 15 (This invention) | 30 | 0 | 29 | 1.5 | 15 | 2.05 |
| 16 (This invention) | 40 | 0 | 39 | 2 | 20 | 2.00 |

When about 200 grains in each of the emulsions 9 to 16 were measured by an EPMA process to determine the silver iodide distribution between grains, the silver iodide content of all grains was in a range of ±20% of the total silver iodide content on formulation.

It can be concluded from these results that silver iodide content of each grain is relatively uniform and the distinct peaks shown by X-ray diffractiometry mean the presence of a distinct stratiform structure in each grain.

The shape of grains after shell formation was octahedron or tetradecahedron having very few faces (100).

After these emulsions were desalted, they were subjected to optimum chemical sensitization by adding sodium thiosulfate and chloroaurate. Coated samples were produced by the same manner as in Example 1, and sensitometry of them was carried out. Results are shown in Table 5.

TABLE 5

| Sample No. | Emulsion No. | Fog | Gamma | Relative sensitivity |
|---|---|---|---|---|
| 9 (Comparison) | 9 | 0.28 | 0.90 | 100* |
| 10 (Comparison) | 10 | 0.27 | 0.85 | 120 |
| 11 (Comparison) | 11 | 0.19 | 0.85 | 140 |
| 12 (Comparison) | 12 | 0.12 | 0.80 | 190 |
| 13 (This invention) | 13 | 0.09 | 0.80 | 420 |
| 14 (This invention) | 14 | 0.10 | 0.80 | 800 |
| 15 (This invention) | 15 | 0.08 | 0.75 | 780 |
| 16 (This invention) | 16 | 0.08 | 0.70 | 780 |

*: The sensitivity of Sample 9 is taken to be 100.

It is understood from Table 5 that samples 13 to 16 of the present invention have very high sensitivity and show low fog.

EXAMPLE 3

The fact that high sensitivity of the emulsions obtained in the present invention is not caused only by an increase of the amount of light absorption is shown in the following experiment. Relative quantum sensitivity of the coated sample used in Example 2 was measured by the following method.

Light absorbance at 420 nm of the coated sample was measured by a method described in *Nippon Shashin Gakkaishi*, VOL. 41, 325 (1978). Using an interference filter, exposure to monochromatic light of 420 nm was carried out with a stepwedge. The amount of exposure in this case was measured by a radiometer of EGG, and an average absorption photon number per emulsion grain was determined from the amount of silver coated and the light absorbance. The exposed sample was subjected to development processing shown in Example 1 (excluding bleaching step), and the amount of development silver was measured by a fluorescent X-ray analyzer. As the relative quantum sensitivity, the number of absorbed photon per grain necessary to develop (silver amount of fog +10% of silver amount coated) was used. Results are shown in Table 6.

TABLE 6

| | Emulsion No. | Relative quantum sensitivity* |
|---|---|---|
| 9 | (Comparison) | 30 |
| 10 | (Comparison) | 32 |
| 11 | (Comparison) | 30 |
| 12 | (Comparison) | 28 |
| 13 | (This invention) | 15 |
| 14 | (This invention) | 9 |
| 15 | (This invention) | 11 |
| 16 | (This invention) | 14 |

*The number of absorbed photons per grain necessary to develop silver of fog + 10%. The smaller the numeral is, the higher the quantum sensitivity is.

It is understood from Table 6 that silver halide grains having a distinct stratiform structure according to the present invention have very high relative quantum sensitivity.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material having at least one silver halide emulsion layer on a support, wherein chemically sensitized silver halide grains contained in at least one of said emulsion layers have a distinct stratiform structure having substantially two parts comprising an inside core part and a shell part of the uppermost layer, wherein the inside core part of said grains is composed of silver halide containing 10 to 45% by mol of silver iodide, the shell part of the uppermost layer of said grains is composed of silver halide containing 5% by mol or less of silver iodide, and the emulsion containing silver halide grains having the distinct stratiform structure has an average silver iodide content of 7% by mol or more, and wherein the X-ray diffraction pattern of the emulsion composed of chemically sensitized silver halide grains having a distinct stratiform structure having substantially two parts shows two diffraction maximums comprising a peak corresponding to the core part having a high silver iodide content and a peak corresponding to the shell part having a low silver iodide content and a minimum part between the two peaks; and a diffraction intensity corresponding to the core part is 1/10 to 3/1 of that of the shell part; and a diffraction intensity of the minimum part is 90% or less of that of the diffraction maximum having a lower intensity of the two diffraction maximums.

2. A silver halide photographic light-sensitive material as claimed in claim 1, wherein the emulsion is a monodispersed emulsion.

3. A silver halide photographic light-sensitive material as claimed in claim 1, wherein the diffraction intensity corresponding to the core part is 1/5 to 3/1 of that of the shell part.

4. A silver halide photographic light-sensitive material as claimed in claim 3, wherein the diffraction intensity corresponding to the core part is $\frac{1}{3}$ to 3/1 of that of the shell part.

5. A silver halide photographic light-sensitive material as claimed in claim 1, wherein the diffraction intensity of the minimum part is 80% or less of the maximum value of the peak having lower intensity.

6. A silver halide photographic light-sensitive material as claimed in claim 5, wherein the diffraction intensity of the minumum part is 60% or less of the maximum value of the peak having lower intensity.

7. A silver halide photographic light-sensitive material as claimed in claim 1, wherein the silver iodide content in the core part is 15 to 45% by mol.

8. A silver halide photographic light-sensitive material as claimed in claim 7, wherein the silver iodide content of the core part is 20 to 45% by mol.

9. A silver halide photographic light-sensitive material as claimed in claim 1, wherein the silver iodide content of the shell part is 2% by mol or less.

10. A silver halide photographic light-sensitive material as claimed in claim 1, wherein the shell part is composed of silver bromide.

11. A silver halide photographic light-sensitive material as claimed in claim 1, wherein the whole silver halide grains having a distinct stratiform structure have an average silver iodide content of 9% by mol or more.

12. A silver halide photographic light-sensitive material as claimed in claim 11, wherein the whole silver halide grains having a distinct stratiform structure have an average silver iodide content of 12% by mol or more.

13. A silver halide photographic light-sensitive material as claimed in claim 1, wherein the silver halide grains have 50% or more of the face (111).

14. A silver halide photographic light-sensitive material as claimed in claim 1, wherein the molar ratio of the silver amount of the core part to that of the shell part is in a range of 1/5 to 5.

15. A silver halide photographic light-sensitive material as claimed in claim 14, wherein the silver amount of the core part to that of the shell part is in a range of 1/5 to 3.

16. A silver halide photographic light-sensitive material as claimed in claim 15, wherein the silver amount of the core part to that of the shell part is in a range of 1/5 to 2.

17. A silver halide photographic light-sensitive material as claimed in claim 1, wherein the average grain size of the silver halide grains is 0.4 μm or more.

18. A silver halide photographic light-sensitive material as claimed in claim 17, wherein the average grain size of the silver halide grains is 0.8 μm or more.

19. A silver halide photographic light-sensitive material as claimed in claim 18, wherein the average grain size of the silver halide grains is 1.4 μm or more.

20. A silver halide photographic light-sensitive material as claimed in claim 1, wherein the light-sensitive material is a color light-sensitive material.

21. A silver halide photographic light-sensitive material as claimed in claim 20, wherein an emulsion comprising grains having a distinct stratiform structure having substantially two parts is used for a blue-sensitive layer.

22. A silver halide photographic light-sensitive material as claimed in claim 20, wherein a layer adjacent to the emulsion layer comprising silver halide grains having a distinct stratiform structure having substantially two parts contains fine silver halide grains having a grain size of 0.2 μm or less.

23. A silver halide photographic light-sensitive material as claimed in claim 2, wherein a layer comprising silver halide grains having a distinct stratiform structure having substantially two parts contains a spectral sensitizing dye having a sensitivity in a blue range.

* * * * *